US008322323B2

(12) United States Patent
Wagner

(10) Patent No.: US 8,322,323 B2
(45) Date of Patent: Dec. 4, 2012

(54) FLUID SYSTEM FOR OSCILLATING-PISTON ENGINES

(75) Inventor: Arnold Wagner, Winterthur (CH)

(73) Assignee: Arnold Wagner, Winterthur (CH)

( * ) Notice: Subject to any disclaimer, the term of this patent is extended or adjusted under 35 U.S.C. 154(b) by 916 days.

(21) Appl. No.: 12/278,627

(22) PCT Filed: Feb. 9, 2007

(86) PCT No.: PCT/CH2007/000067

§ 371 (c)(1),
(2), (4) Date: Dec. 30, 2008

(87) PCT Pub. No.: WO2007/090314

PCT Pub. Date: Aug. 16, 2007

(65) Prior Publication Data

US 2009/0151683 A1 Jun. 18, 2009

(30) Foreign Application Priority Data

Feb. 10, 2006 (CH) ..... 217/06

(51) Int. Cl.

| | |
|---|---|
| ***F02B 33/44*** | (2006.01) |
| ***F01C 3/06*** | (2006.01) |
| ***F01C 20/18*** | (2006.01) |
| ***F04C 14/18*** | (2006.01) |
| ***F04C 2/00*** | (2006.01) |

(52) U.S. Cl. ..... 123/241; 123/245; 123/18 R; 418/68; 418/270; 418/32

(58) Field of Classification Search ..... 123/241, 123/245, 18 R, 18 A, 18 AA; 418/68, 270, 418/32

See application file for complete search history.

(56) References Cited

U.S. PATENT DOCUMENTS 2,336,225 A 12/1943 Coleman ..... 418/163

(Continued)

FOREIGN PATENT DOCUMENTS

DE 199 00 132 A1 7/2000

(Continued)

*Primary Examiner* — Thai Ba Trieu

(74) *Attorney, Agent, or Firm* — Kilpatrick Townsend & Stockton LLP

(57) ABSTRACT

The fluid system is intended for an oscillating-piston engine (100) which has at least two double-armed oscillating pistons (4) arranged in a spherical housing (19) and revolving together about an axis (23) of revolution arranged in the housing center, wherein the oscillating pistons, when revolving, mutually perform reciprocating oscillating movements about an oscillation axis (24) perpendicular to the axis (23) of revolution, and guide members (5) attached to at least two pistons (4) engage in at least one guide groove (17) formed in the housing (19) and serving to control the oscillating movements. The fluid system (70) comprises at least one central feed opening (1), lying in the vicinity of an end of the axis (23) of revolution, for a fluid, continuous cavities and/or bores (10) in the pistons (4) for the fluid, and a fluid discharge on the outer side (3) of the respective piston. A rotation of the pistons (4) about the axis (23) of revolution causes a pressure difference which acts as suction at the feed opening (1) and as pressure in the discharge region (16) and thus makes possible a pumpless fluid system or a fluid system which needs only a low supply pressure. The fluid system serves, for example, to lubricate the oscillating-piston engine (100) and—when fuel is used as the fluid—can be supplied with fluid from a fuel tank together with a fuel supply and with cooling of the oscillating-piston engine.

14 Claims, 4 Drawing Sheets

U.S. PATENT DOCUMENTS

| | | | | |
|---|---|---|---|---|
| 2,621,852 | A | 12/1952 | Pisa | 418/68 |
| 3,884,601 | A | 5/1975 | Anthony | 418/90 |
| 6,390,052 | B1 * | 5/2002 | McMaster et al. | 123/241 |
| 6,579,081 | B1 * | 6/2003 | Kuznetsov | 418/68 |
| 7,435,064 | B2 * | 10/2008 | Huttlin | 418/68 |
| 7,469,673 | B2 * | 12/2008 | Wagner | 123/241 |
| 7,563,086 | B2 * | 7/2009 | Huttlin | 418/68 |
| 2005/0186100 | A1 * | 8/2005 | Weatherbee | 418/68 |

FOREIGN PATENT DOCUMENTS

| | | | |
|---|---|---|---|
| EP | 0 627 551 | A2 | 12/1994 |
| GB | 2 056 562 | A | 3/1981 |
| GB | 2 295 857 | A | 6/1996 |
| WO | WO 02/33238 | A1 | 4/2002 |
| WO | WO 2005/098202 | A1 | 10/2005 |

* cited by examiner

FLUID SYSTEM FOR OSCILLATING-PISTON ENGINES

CROSS-REFERENCES TO RELATED APPLICATIONS

This application is a National Stage of International Application No. PCT/CH2007/000067, filed Feb. 9, 2007, and which claims the benefit of Swiss Patent Application No. 217/06, filed Feb. 10, 2006, the disclosures of these applications being incorporated herein by reference.

BACKGROUND OF THE INVENTION

The invention relates to a fluid system for an oscillating-piston engine having at least two oscillating pistons arranged in a spherical housing and revolving together around an axis of revolution arranged in the housing centre, each of them having two opposing piston arms and which when revolving, mutually perform reciprocating oscillating movements in opposite directions about an oscillating axis perpendicular to the axis of revolution, wherein guide members attached to at least two piston arms engage in at least one guide groove formed in the housing and serving to control the oscillating movements.

These oscillating-piston engines belong to the type of combustion engines in which the combustion strokes of intake, compression, expansion and exhaust of the fuel mixture according to the Otto or Diesel four-stroke method with externally-supplied ignition and self-ignition, respectively, are achieved by oscillating movements of the revolving pistons between two end positions.

Such an oscillating piston engine known from WO 2005/098202 A1 has fluid feeds from the inner piston side to the loose spherical or ellipsoidal rotational bodies serving as guide members. Instead of these loose guide members, radially rotatable rollers connected fixed to the pistons can also exist as they are described, for example, in U.S. Pat. No. 3,075,056 and WO 03/067033. For these guide members, lubrication is also provided or necessary, respectively. For the first one of the above-mentioned oscillating-piston engines, furthermore, an internal cooling by means of fluid is described, in which behind the side faces as well as behind the inner piston faces, which enclose the working chambers, cavities filled with fluid are arranged, which heat up by the heat transfer coming from the inner faces of the working chambers and transfer this heat by means of fluid circulation to the tank and, if necessary, to fluid-cooling devices. In addition, the bearings of the revolving oscillating axis and the sealing elements running on the inner side of the housing must be lubricated. The fluid system is supposed to protect machine parts rubbing against each other by means of appropriate lubrication against excessive wear, to improve the efficiency by reducing the resistance to rotation, and, if necessary, to additionally ensure cooling by heat dissipation by means of heating up a fluid and dissipation from the engine.

BRIEF SUMMARY OF THE INVENTION

It is the object of the invention to respectively create for different applications and designs of the oscillating-piston engines a fluid system, characterized by simplicity, minimal fluid loss or consumption, respectively, suitable fluid means and minimal friction, i.e. minor wear and hence a long service life, and to utilize synergies between the fluid systems of lubrication, fuel supply, and engine cooling.

This object is solved according to the invention by an oscillating-piston engine according to embodiments disclosed herein.

The fluid system is provided for an oscillating-piston engine, the oscillating-piston engine comprising at least two double-armed oscillating pistons arranged in a spherical housing and a revolving oscillation shaft rotatable about an axis of revolution arranged in the housing centre, wherein the oscillating pistons are attached to the revolving oscillation shaft rotatable about an oscillating axis perpendicular to the axis of revolution such that the oscillating pistons, during a rotation of the revolving oscillation shaft about the axis of revolution revolve together about the axis of revolution, and, when revolving, mutually perform reciprocating oscillating movements in opposite directions about the oscillating axis, wherein guide members attached to at least two pistons engage in at least one guide groove formed in the housing and serving to control the oscillating movements. Each of the pistons comprises at least one channel, which is part of the fluid system and which is floodable with a fluid.

According to the invention, the respective floodable channel comprises at least one cavity formed in or at the respective piston and/or at least one bore formed in the respective piston, wherein the feed of the fluid is carried out from a tank through the housing on at least one end of the revolving oscillation shaft, and the respective cavity in or at the respective piston and/or the respective bore in the respective piston are floodable via bores in the revolving oscillation shaft, and wherein from the respective cavity and/or the respective bore a discharge of the fluid towards the piston surfaces facing the inner side of the housing takes place, so that by means of the centrifugal force generated by a rotation of the revolving oscillating shaft, a suction at the feed conduit as well as a pressure in the discharge conduits is caused near the piston surface and hence an automatic fluid circulation via discharge openings to the tank is activated.

The feed of the fluid is preferably carried out by a calibration nozzle, which determines the fluid passage with respect to the volume. In addition, a check valve can be connected upstream of the feed point, which prevents the return flow of fluid from the engine, for example, at pressure increase due to evaporation. Furthermore, it is suitable to carry out the distribution in the inside of the engine through bores in the revolving oscillation shaft which meet cross-like in the centre. The feed into the revolving oscillation shaft can be carried out via at least one axial bore at the shaft end or at least one radial bore in the bearing. Thereby it is advantageous to provide roller bearings, preferably needle bearings, for the revolving oscillation shaft on the axis of rotation and needle cages on the outside of the pistons on the oscillating axis side of the oscillation shaft because that way only small quantities of fluid are necessary for bearing lubrication. A demand for fluid for these bearings can even be avoided completely by means of sealing and lifetime lubrication. From the revolving oscillating shaft, the bearing arranged at the shaft end opposite to the feed end can be lubricated via at least one radial bore. From the oscillation shaft portion, fluid is conducted via, respectively, at least one radial bore and one ring groove and/or an axially extending lubrication groove in the pistons and through the axial bearings, preferably formed as needle cages, which receive the centrifugal forces of the pistons, into cavities, which, for example, can be formed with spherical-shaped calotte covers (hereinafter called "spherical calotte cover") attached to the respective pistons at the respective pistons. In these cavities adjacent to the working chambers and separated from it by the side faces of the piston, a heating of the fluid, and hence a heat transfer to it, takes place.

Furthermore, the inner faces of the working chamber are backfilled with bores or chambers extending from these cavities, which bores and chambers also fill up with fluid and take over heat from the inner faces of the working chamber. In high power machines, this heat transfer can result in evaporation of the fluid and therefore discharge a very high quantity of heat from the pistons, which have at least one discharge conduit towards the inner side of the guide members in the outer side of the piston. By means of the rotation of the loose guide members, or by means of gap losses in case of fixed roller guides, fluid circulation from the feed opening through the inner engine is created, by which shaft and piston bearings as well as guide members and guide grooves are continuously lubricated, and by means of the circulation further to the discharge openings in the guide grooves, heat is continuously discharged to the tank and through its outer housing surfaces or, if necessary, via a fluid cooler. For lubrication of the sealing rings or sealing rails, it is advantageous to provide calibrated connection bores (hereinafter "calibration bores") from the cavities of the spherical calotte covers or from the cavities of the bores behind the inner faces of the working chamber into the sealing ring, or sealing rail mounting grooves. Thereby, on the one hand, the sealing of these sealing members to the working chambers or pre-chambers, respectively, by means of fluid filling of the mounting grooves and hydraulic contact pressure is improved, and, on the other hand the lubrication between sealing member and inner spherical housing by means of gap losses is ensured.

As fluid, normally engine oils, such as for reciprocating piston engines, are considered. It is also possible, in particular with self-ignition engines, to use diesel fuel for this purpose or, with simple, smaller machines, to achieve lubrication by adding oil to gasoline. In this case, instead of the engine oil, these fluids are passed on the described circulation through the inner engine and subsequently to the fuel tank or to the injection or carburetor, respectively.

Furthermore, according to the invention, for example in the case of self-ignition engines, it is also possible for the engine housing liquid cooling, instead of a coolant mixture such as water+antifreeze, to use diesel fuel, respectively, which is conducted from the fuel tank into the cooling jacket of the housing and then is cooled via an air-ventilated cooler and conducted back into the tank. For such a design of the fluid system, therefore, for lubrication, cooling and fuel supply, only one tank is necessary, in which the outflow for the fuel supply is taken advantageously above a reserve level sufficient for cooling and lubrication, so that the machine is securely lubricated and cooled until fuel shortage.

Hereinafter the invention is described by means of the attached drawings. In the figures,

BRIEF DESCRIPTION OF THE DRAWINGS

FIGS. 1 to 3 show an oscillating-piston engine 100 having a fluid system 60 according to the invention.

DETAILED DESCRIPTION OF THE INVENTION

Figure 1:
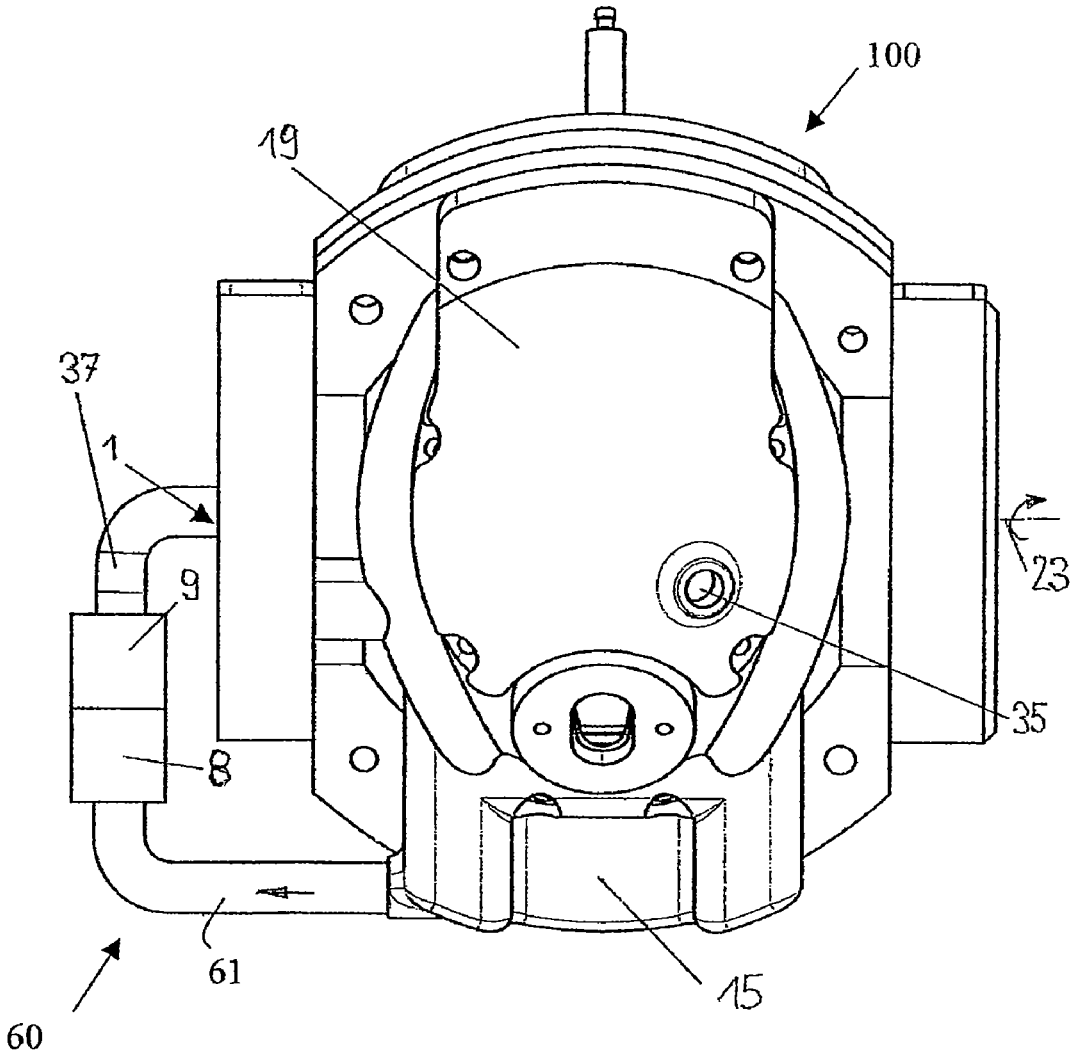
FIG. 1 shows a general view from the side of an oscillating-piston engine having two pistons arranged at a revolving oscillation shaft, and a fluid system according to the invention.

The oscillating-piston engine 100 comprises, among other things, a spherical housing 19, a revolving oscillation shaft 25 supported at its ends in the housing wall and rotatable about an axis 23 of revolution arranged in the housing centre, and two oscillating pistons 4 attached to the revolving oscillation shaft 25. Each of the oscillating pistons 4 comprises two piston arms 4.1 and 4.2 diametrically opposed with respect to the axis 23 of revolution and is attached to the revolving oscillation shaft 25 rotatable about an oscillating axis 24 perpendicular to the axis 23 of revolution in such a manner that the oscillating pistons 4 during a rotation of the revolving oscillation shaft 25 about the axis 23 of revolution revolve together about the axis 23 of revolution and, additionally, when revolving, mutually perform reciprocating oscillating movements in opposite directions about the oscillating axis 24. To control the respective position of the pistons relative to the axis 23 of revolution and to the oscillating axis 24, respectively, to at least two pistons 4, guide members are attached, which engage in at least one guide groove 17 formed in housing 19, and serving to control the oscillating movements.

In the present case, each of the guide members 5 are loose spherical rotational bodies, each of them supported on the piston side in support socket 39, formed at one of the pistons 4, wherein the support socket 39—corresponding to the shape of the respective rotational bodies 39—is formed hemispherical. Alternatively, the guide members 5 can be realized also as radial rollers, wherein the rollers can be held in a roller bearing or slide bearing member formed at the respective piston 4. Such arrangements of guide members in the form of rotational bodies or rollers, respectively, are, for example, disclosed also in WO 2005/098202 or WO 03/067033, respectively.

The space between the (adjacent) piston arms 4.1 of the two pistons 4 and the inner side 2 of the housing 19 forms a working chamber 4.1', and the space (located opposite with respect to the revolving oscillation shaft 25) between the (adjacent) piston arms 4.2 of the two pistons 4 and the inner side 2 of the housing 19 forms a working chamber 4.2'. The volume of the respective working chamber 4.1' or 4.2', respectively, depends on the actual position of the pistons 4, and varies periodically during revolving of the revolving oscillation shaft 25 or the pistons 4, respectively, about the axis 23 of revolution between a minimum value and a maximum value.

To operate the oscillating-piston engine 100 as a internal combustion engine, fuel can be injected via an injection valve 20 (depending on the position of the pistons 4) inserted through the housing 19 selectively into the working chamber 4.1' or the working chamber 4.2', and subsequently be ignited in the respective working chamber, wherein the combustion of the fuel causes an oscillating movement of the pistons 4 in opposite directions about the oscillating axis 24 and correspondingly a rotation of the pistons 4 or the revolving oscillation shaft 25, respectively, about the axis 23 of revolution.

For sealing of the working chambers 4.1' or 4.2', respectively, sealing elements 6 between the respective pistons 4 and the inner side 2 of the housing 19 or the revolving oscillation shaft 25, respectively, are provided, wherein the sealing elements 6 are held in respective mounting grooves 7 formed in the pistons 4.

Figure 2:
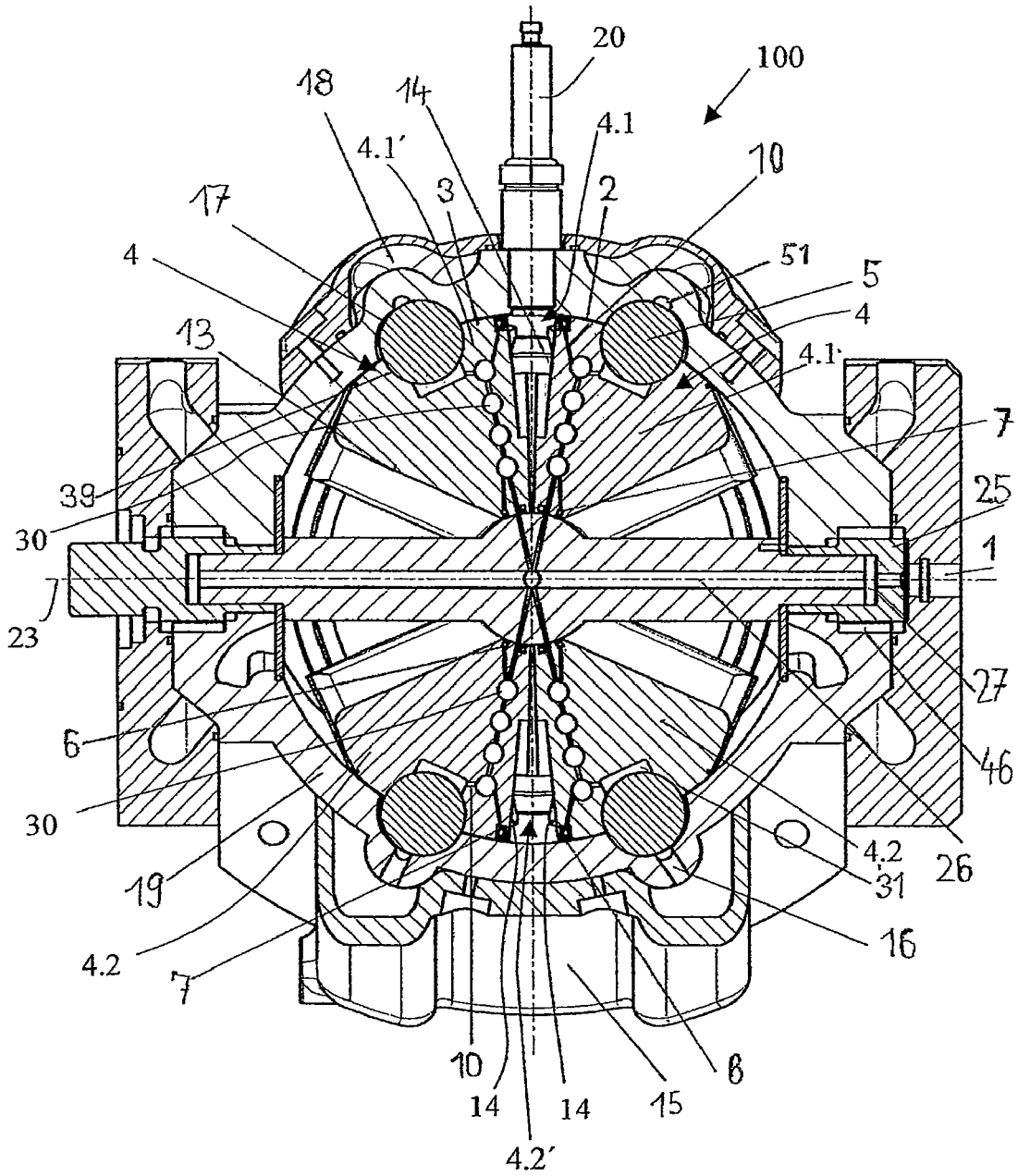
FIG. 2 shows the oscillating-piston engine according to FIG. 1 cut in direction of the axis of revolution.
Figure 3:
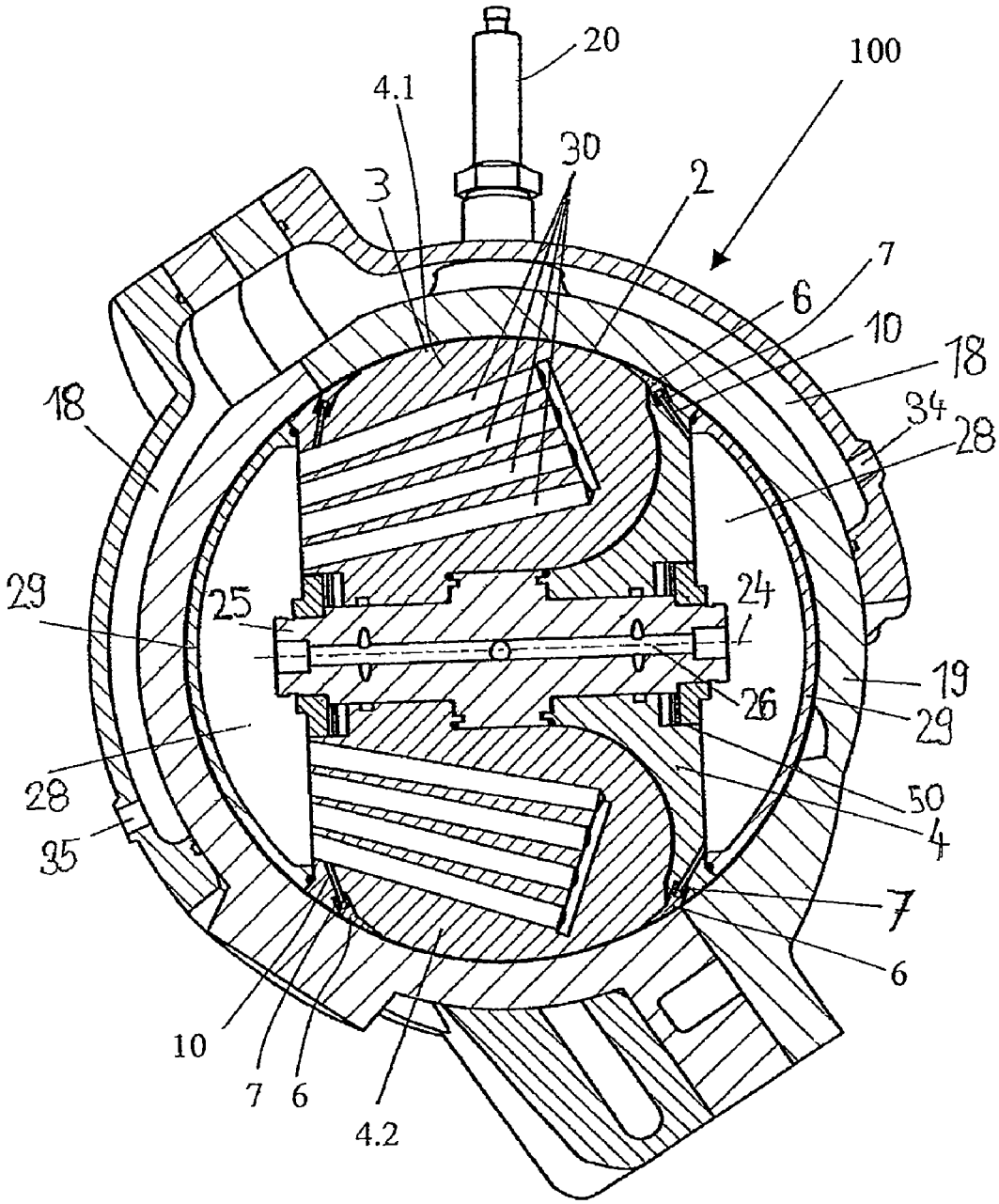
FIG. 3 shows the oscillating-piston engine according to FIG. 1 cut in direction of the oscillating axis, wherein inside the machine the pistons are shown in a section view along the oscillating axis.

The oscillating-piston engine 100 (as indicated in FIGS. 1 to 3) can be operated as self-ignition engine. Alternatively, the oscillating-piston engine 100 can be equipped with a spark plug (not shown in the Figs.) for ignition of the fuel supplied into one of the working chambers 4.1' or 4.2', respectively, to operate the oscillating-piston engine 100 as engine with externally-supplied ignition.

The fluid system 60 comprises a tank 15 (in the present case flange-mounted to the housing 19) for a fluid, a system of channels (which will be specified hereinafter in more detail), being arranged inside the oscillating-piston engine 100 and floodable with fluid and continuously open for the fluid, a pipe 61 for feeding the fluid from the tank 15 into the complete system of channels, and a return flow of the fluid from the mentioned system of channels into the tank 15 via discharge openings 16 formed in the housing 19 for the fluid, to realize a closed-loop circulation for the fluid.

The flow of fluid through the interior of the oscillating-piston engine 100 (along the mentioned system of channels) is organized as follows.

As indicated in FIG. 1, a calibration nozzle 9 for regulation of the flow rate of the fluid, and a check valve 37 (for prevention of backflow into the tank 15) are installed in the pipe 61, wherein the arrow at the pipe 61 in FIG. 1 indicates the flow direction of the fluid. The pipe 61 runs into a feed opening 1 for the fluid in the wall of the housing 19. The feed opening 1 is open towards one end 27 of the revolving oscillation shaft 25 and allows the feeding of the fluid from the pipe 61 into bores 26 (each of them open on both ends), which extend in the revolving oscillation shaft 25 along axis 23 of revolution (see FIG. 2) and along oscillating axis 24 (see FIG. 3) and are each crossing in the middle of their longitudinal extent. In this manner a flow of the fluid in the revolving oscillation shaft 25 along the axis 23 of revolution and the oscillating axis 24 is possible.

From the bores 26 in the revolving oscillation shaft 25, a flow of the fluid towards the piston surfaces 3 facing the inner side 2 of the housing is possible in different ways.

On each side of the respective piston 4, by means of a spherical calotte cover 29 (attached to the respective piston 4), a cavity 28 (with the shape of a spherical segment) is formed, which is floodable with the fluid via an opening on one end of the bore 26, or, in case of closed ends of the bores 26 at the oscillating shaft portion of the revolving oscillation shaft 25, via the axial bearing 50. It has to be pointed out that the two cavities 28 illustrated in FIG. 3, which are arranged on opposing ends of the revolving oscillation shafts 25, are formed at different pistons 4, and therefore, during oscillating movements of the two pistons 4, perform movements of rotation in opposite directions relative to each other about the oscillating axis 24.

Each of the pistons 4 has in each of the piston arms 4.1 and 4.2, near by the inner sides 14 of the working chambers, a plurality of bores 30, each of them floodable with the fluid from one of the cavities 28. From the bores 30, in turn, different calibration bores 10 lead to the mounting grooves 7 for the sealing elements 6 and to the discharge conduits 31 below the respective guide members 5.

The fluid can leak from the mounting grooves 7 (via gaps, which are formed between each of a sealing element 6 and a respective mounting groove 7) and the discharge conduits 31 (via gaps, which are formed between each of guide member 5 and the respective support socket 39) from the pistons 4 to the inner side 2 of the housing, and, for example, reach the guide grooves 17. Along each of the guide grooves 17, a respective discharge groove 51 is formed, in which the fluid can discharge, passing the respective guide members 5, to the already-mentioned discharge openings 16 and from there to the tank 15.

As FIG. 2 further indicates, the oscillating-piston engine 100 has cavities 18 on the outer side of housing 19 for a cooling fluid, wherein the cooling fluid can penetrate via a cooling fluid feed opening 34 (see FIGS. 3 and 4) into the cavities 18 and can leave the cavities 18 via a cooling fluid discharge opening 35 (see FIGS. 1 and 3).

Figure 4:
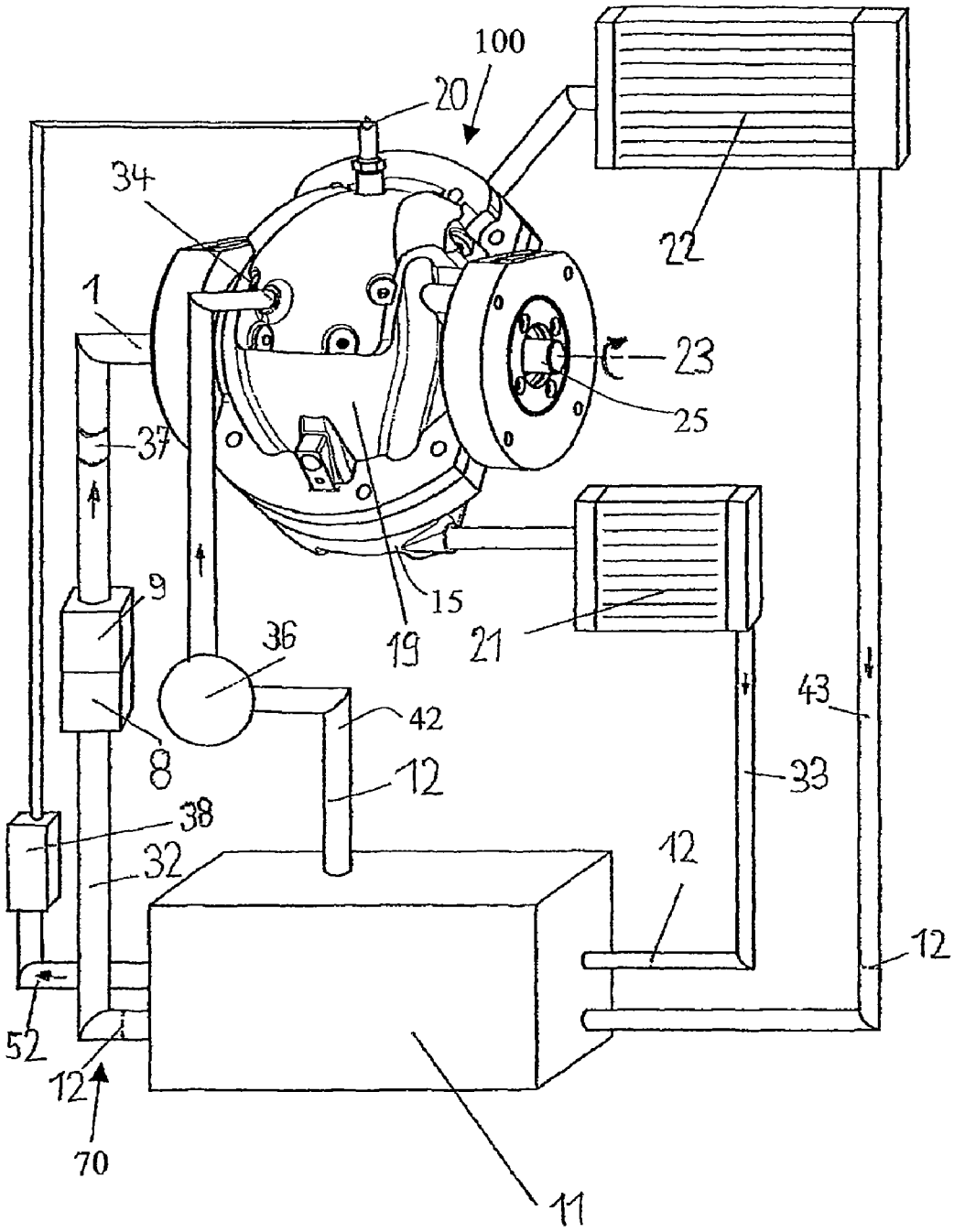
FIG. 4 shows a schematic/perspective view of a complete system of an oscillating-piston engine, which comprises a further embodiment of the fluid system according to the invention in combination with an engine fuel injection and an engine cooling system, all preferably supplied with diesel fuel from the same fuel tank, wherein injection, fluid supply, and cooling system each are provided with their own feed pumps, and the return pipes of lubrication and cooling system are each provided with their own cooling bodies.

FIG. 4 shows the oscillating-piston engine 100 already described with respect to FIGS. 1 to 3 in connection with another fluid system 70 formed according to the invention. In the present case, the system 70 is combined with a fuel injection and with a cooling system, wherein the fluid system 70 serves for feeding a fluid via a (connection) pipe 32 into the feed opening 1, and the cooling system serves for feeding a (cooling) fluid via a (connection) pipe 42 into the cooling fluid feed opening 34, and the fuel injection serves for feeding fuel via a (connection) pipe 52 into the injection valve 20. The (connection) pikes 32, 42 and 52 are all connected with a fuel tank 11, which provides the fluid system 70, the cooling system and the fuel injection with a fluid, preferably diesel fuel.

The fluid system 70 comprises also a (connection) pipe 33 between the tank 15 and the fuel tank 11, to ensure a return flow of the fluid fed through feed opening 1 to the fuel tank 11. A (connection) pipe 43 between the cooling fluid discharge opening 35 (not visible in FIG. 4 but illustrated in FIG. 3) and the fuel tank 11 provides accordingly for a return flow of the fluid fed into the cooling fluid feed opening 34 to the fuel tank 11. The pipes 32, 42 and 52 are each provided with a separate (feed) pump 8 and 36 and 38, respectively. The pipes 33 and 43 are each equipped with separate cooling bodies 21 or 22, respectively, for the fluid flowing back to the fuel tank 11. The arrows at the pipes 32, 33, 42, 43 and 52 in FIG. 4 each denote the flow direction of the fluid.

By means of the arrangement and formation according to the invention of feed opening 1 in centre or near to side of the axis 23 of revolution, and flooding the bores 26 in the revolving oscillation shaft 25 on the one end 27 thereof, and passing through towards the piston surface 3 facing the inner side 2 of the housing, while flowing through the rotating oscillating piston 4 from the inside to the outside during the operation of the oscillating-piston engine, fluid is exposed to an increasing centrifugal force, which increases squared to the revolutions. Thereby, a pressure difference is generated, which acts as a suction at the feed opening 1 as well as a pressure below the guide members 5 and below the sealing elements 6 in their mounting grooves 7. Therefore, in case of a fluid supply of oscillating-piston engines performed according to the invention, only a low or even no supply pressure is necessary. It is sufficient to conduct, in case of a small suction height, without supply pressure and pumpless, or in case of a higher suction resistance, due to height and a check valve 37 or a filter, by means of a simple membrane pump 8 actuated by the pressure changes in housing 19, lubrication fluid to the feed opening 1 with a pressure of about 0.2 bar (20 kPa) to ensure a proper function of the fluid circuit.

The fluid flow velocity is determined by the fluid pre-pressure to the feed opening 1, the adjustable or replaceable calibration nozzle 9, the viscosity of the fluid, the inner diameter of the housing 19, the revolution speed of the oscillating-piston engine 100, and the cross section of the calibration bores 10 to the sealing elements 6 and to the guide members 5. By exact adjustment of these regulating elements, very simple lubrication systems as well as a minimal fluid consumption can be realized.

The fluid discharge is carried out mainly through the discharge grooves 51, placed on top of the guide grooves 17, extending to the discharge openings into the tank 15. Complex high pressure systems, such as, for example, for crankshafts supported in slide bearings in reciprocating piston engines, are eliminated for oscillating-piston engines according to the invention.

As a fluid, normal engine oil is considered. In case of self-ignition engines, diesel fuel can also be used for lubrication, and the fluid system—as in the example according to FIG. 4—can be connected to the fuel tank 11. For purpose of fire safety, in this case the connections 32, 33 are to be separated by means of fine screens 12 to prevent penetration.

In case of smaller, simple engines with externally-supplied ignition, an injection or loss lubrication, such as for two-stroke engines, is also possibly occurred. Here, for example, self-mixing oil is sucked by the calibration nozzle 9, which is precisely adjusted for dosing the mixture ratio, out of the supply tank 15, and the inflow is automatically regulated by the engine revolution via the centrifugal force depending thereon, or a premixed fuel from tank 11 is used and then consumed as fuel via injection or carburetor. In case of the variant with dosed, self-mixing oil, by means of the fluid gap losses at the sealing elements 6 on the inner sides of the pre-chamber 13 or the working chamber 14, respectively, a mixing with the gasoline fed via the fuel system is caused, and a loss lubrication, such as for two-stroke engines for the lubrication of the sealing elements 6, is achieved, whereas the shaft bearing 46, axial bearing 50, and the guide members 5 are served by the fluid circulation via discharge openings 16 in the guide grooves 17. A lubrication with a two-stroke mixture of gasoline and 1% to 5% self-mixing oil by premixing in the fuel tank 11, and/or by adding into the separate supply pipe 32 to the calibration nozzle 9 and to the feed opening I, or, in case of suitable material combinations of sealing elements 6 with the inner surfaces 2 of the housing and sealed bearings, a pure gasoline lubrication is also possible, wherein the fuel backflow from the discharge openings 16 is conducted to the injection or the carburetor, respectively.

Furthermore, the fluid system can also be used for outer cooling of the oscillating-piston engine, wherein the cooling cavities 18 outside of the spherical housing 19 are flooded with fluid through cooling fluid feed opening 34, and through cooling fluid discharge opening 35, with or without the interconnected main cooler 22, a return flow 43 to the fuel tank 11 takes place. For this, a self-ignition engine is particularly suitable, since diesel fuel is suitable as lubrication fluid for lubrication in the inner engine and also as cooling fluid for an outer cooling of the engine, especially because diesel fuel is characterized by properties which are suitable for this application with respect to lubrication capability, viscosity, and boiling point. In this case, the fuel injection valve 20 and the fluid system through the feed opening 1 as well as the outer cooling system through cooling fluid feed opening 34 are served from fuel tank 11, partially via the same or via separate supply pipes, and, if required, by necessary supply rates and pressure conditions, with shared or with separate feed pumps 8, 36, 38. The return flow of fluid takes place through a direct connection or through a fluid cooler 21 to the fuel tank 11, whereas the return flow of the fuel used for the outer cooling requires in most cases an interconnected main cooler 22. Also here, for purpose of fire safety, fine screens 12 are to be provided at appropriate positions between machine side and fuel tank.

The use of this combined fuel-lubrication-cooling system is also possible for gasoline-driven engines with externally-supplied ignition. However, for engine lubrication as well as for the outer cooling, operating with overpressure is necessary to raise the boiling point of gasoline to the desired coolant temperature range. Thereby, however, the requirements for supply pipes, feed pumps, the control of the pressure conditions, as well as for cooler and return pipes are considerably increased. In addition, because of the reduced lubrication capability of gasoline, sealed bearings 46, 50 with self-lubrication should be used at the revolving oscillation shaft 25.

The invention claimed is:

1. An oscillating-piston engine, comprising:

a spherical housing defining at least one guide groove therein;

at least two double-armed oscillating pistons disposed in the housing;

a revolving oscillation shaft, rotatable about an axis of revolution disposed at a center of the housing, wherein the revolving oscillation shaft comprises bores extending along the axis of revolution and the oscillating axis, wherein the oscillating pistons are attached to the revolving oscillation shaft rotatable about an oscillating axis perpendicular to the axis of revolution, such that the oscillating pistons, during a rotation of the revolving oscillation shaft about the axis of revolution, revolve together about the axis of revolution, and when revolving, mutually perform reciprocating oscillating movements in opposite directions about the oscillating axis;

guide members attached to the pistons, wherein the guide members engage in the at least one guide groove of the housing, and serve to control the oscillating movements; and a fluid system for supply with a fluid, comprising at least one tank for the fluid, a feed opening for the fluid in the housing, and a pipe connected with the tank for supplying the fluid from the tank to the feed opening, wherein the feed opening is open towards an end of the revolving oscillation shaft;

wherein each of the pistons comprises at least one channel floodable with the fluid;

wherein a feed of the fluid is supplied from the tank through the feed opening, and via the bores of the revolving oscillation shaft the channel of each of the pistons is floodable with the fluid;

wherein each of the pistons further comprises at least one discharge conduit configured to discharge the fluid from a respective one of the channels towards a piston surface facing an inner side of the housing so that by means of a centrifugal force generated by a rotation of the revolving oscillating shaft, a suction at the feed opening as well as a pressure in each of the discharge conduits is caused near the piston surface thus effecting an automatic fluid circulation via discharge openings to the tank.

2. The oscillating-piston engine according to claim 1, further comprising a calibration nozzle configured to influence the flow rate of the fluid, disposed upstream or downstream of the feed opening.

3. The oscillating-piston engine according to claim 2, wherein each of the pistons further comprises a mounting groove, with a sealing element disposed therein, each one of the mounting grooves being disposed between a respective one of the pistons and the inner wall of the housing, and a calibration bore extending from a respective one of the channels to a respective one of the mounting grooves, configured for the fluid to be discharged through the calibration bores to the mounting grooves to thereby fill the mounting grooves with the fluid, thereby increasing a contact pressure and an effectiveness of the sealing elements, and, by means of gap losses, lubricating the sealing elements on the inner wall of the housing.

4. The oscillating-piston engine according to claim 3, wherein the fluid comprises an oil which is self-mixing with gasoline, wherein by adjustment of the calibration nozzle and by means of the centrifugal force which depends on a revolution speed of the oscillating-piston engine, a load-dependent fuel-oil mixture by means of oil gap losses at the sealing elements for loss lubrication of the sealing elements on the inner wall of the housing is automatically generated.

5. The oscillating-piston engine according to claim 4, wherein a portion of the fluid flowing through the guide grooves and the discharge openings is also used for injection or carburetor supply, respectively.

6. The oscillating-piston engine according to claim 1, wherein from the channel of one of the pistons, fluid is discharged through a calibration bore towards the inner wall of the housing and is conducted to one of the discharge conduits disposed below the guide members, wherein of the guide members comprise loose rotational bodies, and wherein the fluid is conducted to a side of the respective rotational body facing away from the guide groove, and the respective rotational body thereby is lubricated in a hemispherical support socket formed at the piston and is held free of play in the guide groove by means of the fluid pressure, and a supporting face of the guide members in the guide groove in the housing is also supplied with fluid.

7. The oscillating-piston engine according to claim 1, further comprising a check valve which prevents the return flow of fluid from the housing, disposed upstream or downstream of the feed opening.

8. The oscillating-piston engine according to claim 1, wherein the fluid comprises a fuel, the oscillating-piston engine further comprising a connection pipe disposed between the tank and the feed opening, wherein the connection pipe provides for the fluid supply, and further comprising a return pipe which conveys excess fluid back to the tank.

9. The oscillating-piston engine according to claim 8, further comprising an injection valve configured to inject fuel into a working chamber, and a connection pipe connected to the tank and configured to supply the fluid from the tank to the injection valve, and further configured to remove the fluid from the tank for an engine operation, above a reserve level of the fluid sufficient for cooling and lubrication, and thus an amount of fluid sufficient for lubrication and cooling, being available until fuel shortage.

10. The oscillating-piston engine according to claim 8, further comprising a cooler for the fluid, configured for return flow of the fluid to the tank.

11. The oscillating-piston engine according to claim 8, wherein the fuel comprises diesel.

12. The oscillating-piston engine according to claim 1, wherein the fluid comprises a fuel, and wherein an engine main cooling of the oscillating-piston engine is carried out by means of a fuel circuit with the fluid supplied from the tank preferably with diesel fuel, via a coolant pump to a cooling fluid feed opening and through outer cooling cavities to a cooling fluid outlet back to the tank.

13. The oscillating-piston engine according to claim 12, wherein the fuel comprises diesel.

14. The oscillating-piston engine according to claim 1, wherein from the channel of one of the pistons, fluid is discharged through a calibration bore towards the inner wall of the housing and is conducted to one of the discharge conduits disposed below the guide members, wherein the guide members comprise radial rollers, wherein the radial rollers are lubricated in a roller or sliding bearing part disposed at the piston, and wherein a supporting face of the guide members in the guide groove in the housing is also supplied with fluid.

* * * * *